US005592833A

United States Patent [19]

Moll

[11] Patent Number: 5,592,833

[45] Date of Patent: Jan. 14, 1997

[54] PROCESS AND APPARATUS FOR THE RECOVERY OF PURE ARGON

[75] Inventor: Anton Moll, Raisting, Germany

[73] Assignee: Linde Aktiengesellschaft, Wiesbaden, Germany

[21] Appl. No.: 393,388

[22] Filed: Feb. 23, 1995

[30] Foreign Application Priority Data

Feb. 24, 1994 [DE] Germany ..... 44 06 051.3
Oct. 10, 1994 [DE] Germany ..... 44 36 160.2

[51] Int. Cl.[6] ..... F25J 3/04

[52] U.S. Cl. ..... 62/648; 62/906; 62/924

[58] Field of Search ..... 62/22, 24, 41

[56] References Cited

U.S. PATENT DOCUMENTS

| | | | |
|---|---|---|---|
| 4,296,050 | 10/1981 | Meier | 261/112 |
| 4,883,518 | 11/1989 | Skolaude et al. | 62/38 |
| 4,935,044 | 6/1990 | Schoenpflug | 62/22 |
| 5,019,145 | 5/1991 | Rohde et al. | 62/22 |
| 5,049,173 | 9/1991 | Cormier, Sr. et al. | 62/22 |
| 5,076,823 | 12/1991 | Hansel et al. | 62/22 |
| 5,207,066 | 5/1993 | Bova et al. | 62/22 |
| 5,426,946 | 6/1995 | Corduan et al. | 62/22 |

FOREIGN PATENT DOCUMENTS

| | | |
|---|---|---|
| 0171711 | 2/1986 | European Pat. Off. . |
| 93/01962 | 1/1994 | South Africa . |
| 93/01963 | 1/1994 | South Africa . |

OTHER PUBLICATIONS

Patent Abstracts of Japan, vol. 17, No. 517 (M–1481) (Sep. 17, 1993).

*Primary Examiner*—Ronald C. Capossela
*Attorney, Agent, or Firm*—Millen, White, Zelano & Branigan, P.C.

[57] ABSTRACT

In recovering pure argon product, air is separated in a rectification system, comprising at least one air separating column (9), a crude argon column (17) and a pure argon column (25). A crude argon fraction (24) is withdrawn from the crude argon column (17) and introduced at an intermediate locality into the pure argon column (25). The head of the pure argon column (25) is cooled by indirect heat exchange (29). From the pure argon column (25) a residual fraction (31) containing essentially nitrogen is withdrawn overhead and from the bottom a pure argon fraction (26) is withdrawn. The mass transfer in the pure argon column (25) is brought about at least in part by a packing (33, 34).

21 Claims, 2 Drawing Sheets

PROCESS AND APPARATUS FOR THE RECOVERY OF PURE ARGON

SUMMARY OF THE INVENTION

The invention relates to a process and apparatus for the recovery of pure argon. In the process air is separated in a rectification system by means of at least one air separation column, a crude argon column and a pure argon column. A crude argon fraction is withdrawn from the crude argon column and introduced at an intermediate locality into the pure argon column, the head of which is cooled by indirect heat exchange, preferably against an evaporating fraction. From the upper region of the pure argon column, a residual fraction, essentially containing nitrogen, is withdrawn and from the lower region of the pure argon column a pure argon fraction is withdrawn.

The basic principles of pure argon preparation are described in Hausen/Linde, Tieftemperaturtechnik (Low Temperature Technology), 2nd edition, pp. 332-334 (1985). Processes and apparatus of the type referred to above are moreover known from the patent publications EP-B-0 377 117, EP-A-0 171 711, EP-A-0 331 028, U.S. Pat. No. 5,019,145 and U.S. Pat. No. 4,935,044. Further developments are disclosed in German patent applications P 44 06 049.1 and P 44 06 069.6, related European patent application [EP application claiming priority from German patent applications P 44 06 049.1 and P 44 06 069.6], and related U.S. patent application Ser. No. 08/393,389, which all claim the same priority date as the present application. In this context, air separation, in the narrower sense of separating air into oxygen and nitrogen, is generally performed in a double column having a high pressure column and a low pressure column wherein the input fraction for a crude argon column is withdrawn from the low pressure column. Oxygen-depleted crude argon is then freed of more volatile impurities, in particular nitrogen, in a further rectification column, i.e., a pure argon column. Between the crude argon and pure argon columns a further stage of oxygen removal, for example, by catalytic oxidation with hydrogen (Deoxo apparatus, c.f., e.g., EP-A-0 171 711 or EP-A-0 331 028), may optionally be installed.

The crude argon product is normally recovered at the lowest possible pressure, that is to say just above atmospheric pressure. Its pressure must accordingly be raised prior to introduction into the pure argon column, so that at the head of the pure argon column sufficient excess pressure is still available for discharging overhead product therefrom and to generate reflux (as a rule by condensation of overhead gas in indirect heat exchange with evaporating nitrogen). For that purpose, the intermediate installation of a special compressor is required in many cases, involving corresponding capital and operating costs. Although this can be avoided by liquefication of the crude argon and utilization of the hydrostatic potential (c.f., EP-B-0 377 117), one is thereby subjected to limitations in the geometric arrangement of the pure argon column which, in many cases, due to space conditions, can be complied with only at high cost. Moreover, when dispensing with a compressor, restriction to a certain purity is frequently involved. For example, it may be impossible to attain in the pure argon product a nitrogen content of the order of 100 ppb or less.

Accordingly, an object of the invention is to develop a process and an apparatus of the aforementioned type, which is characterized by particularly good economics, in particular by relatively favorable capital and operating costs for recovering argon at high yields, e.g., about 98% or more of the argon contained in the crude argon fraction, and high purity, e.g., less than about 20 ppm nitrogen.

Upon further study of the specification and appended claims, further objects and advantages of this invention will become apparent to those skilled in the art.

These objects are attained in accordance with the invention in that mass transfer in the pure argon column is brought about, at least in part, by a packing.

The term "packing" in this context invariably includes both random packings as well as structured packings. Structured packings are preferably employed. Examples of special designs of structured packings are described, for example, in DE-A-27 22 424 (see also U.S. Pat. No. 4,296,050), and DE-A-42 09 132 (see also ZA 9301963) or in DE-A-42 24 068 (see also U.S. patent application Ser. No. 08/307,626). Although it was known to employ such packings instead of conventional rectification trays in the double column or in the crude argon column of an air separation system (EP-A-0 321 103, EP-B-0 377 177), such employment in a pure argon column had not been considered appropriate in the past.

The term "packing," even when used in the singular, is intended to include in this context a plurality of sections within a column each packed with a non-structured and/or a structured packing.

By the employment, according to the invention, of packings in the pure argon column, the pressure loss in this column can be reduced to such an extent that special measures for compressing crude argon can be dispensed with. (Obviously this does not preclude utilizing any change in height which may be present in the crude argon duct in any case, for achieving a certain pressure increase.) Within the scope of the invention it was found that in many cases this advantage - in contrast to prior art expectations - clearly exceeds the increased expenditure, so that all in all capital and/or operating costs can be saved.

It was found to be particularly favorable if the mass transfer in the pure argon column above the intermediate position at which the crude argon fraction is introduced is effected at least in part or substantially exclusively by a packing. In this manner, an essential effect of the invention is attained, i.e., a relatively low pressure differential between the inlet for the introduction of crude argon and the overhead condenser of the pure argon column, without the entire pure argon column having to be equipped with expensive packings.

Preferably, the pressure difference between the inlet and head of the pure argon column containing packing is about 4–7 mbar, whereas if the column contained actual trays in this region the pressure difference would be about 40–70 mbar.

In this context, it is possible that the exchange of material in the pure argon column in the lower portion of the pure argon column, that is to say underneath the intermediate locality at which the crude argon fraction is introduced, is brought about in part or even essentially exclusively by trays. This permits a major part of the pure argon column to be fitted with relatively cost-effective mass transfer elements. Details of such rectification or exchange trays, which can be employed within the scope of the invention in the pure argon column, are described in, for example, Winnacker/Küchler, Chemische Technologie, Vol. 7, 3rd edition, Section 3.351, pp. 197–200 (1975).

As an alternative or in addition to the employment of packings in the upper portion of the pure argon column, mass transfer in the pure argon column underneath the intermediate locality at which the crude argon fraction is introduced, may be effected at least in part or essentially exclusively by a packing. The advantageous effect of the packing may then be utilized over a correspondingly large portion of the column height.

The head of the pure argon column may, in this context, be operated in a known manner by indirect heat exchange with liquid nitrogen which, in the course thereof, evaporates. However, it is particularly advantageous if the heat exchange is brought about by cooling the head of the pure argon column with a cooling medium having an oxygen content of at least 10 vol. %, preferably 32–40 vol. %, especially 33–38 vol. %. In this manner, the reflux required in the pure argon column can be generated without valuable liquid nitrogen being evaporated which would then be lost for the rectification in the one or more air separating columns.

For this purpose a variety of liquid process flows can be employed as the cooling medium for indirect heat exchange at the head of the pure argon column. Preferably, the cooling medium is withdrawn from the lower or central region of the one or more air separating columns, in particular from the high pressure stage of a double column. The employment of sump liquid from the high pressure stage of such a double column as cooling medium for the pure argon column, is particularly advantageous.

The reference to "the cooling medium" is not intended to mean that other fractions cannot likewise contribute to the head cooling of the pure argon column, for example by being mixed with the head fraction, by cooling upstream of the heat exchange with "the cooling medium," etc. Nevertheless, the contribution of that fraction which here is expressly referred to as the cooling medium, is the decisive one for generation of reflux at the head of the pure argon column.

The heating of the bottom or sump of the pure argon column may be brought about by the exchange of sensible heat, in that the lower region of the pure argon column is heated by indirect heat exchange with a liquid fraction from the high pressure column of a double column, in particular with sump liquid collected in the lower region of the high pressure column. This manner of heating the pure argon column is also described in detail in German patent application P 44 06 069.6, and European patent application No. [EP application claiming priority from German patent applications P 44 06 049.1 and P 44 06 069.6]and U.S. patent application Ser. No. 08/307,389, which claim the priority of the former. In this context, it is advantageous if at least part of the liquid 10 fraction from the high pressure column, downstream of the indirect heat exchange for heating the lower region of the pure argon column, is utilized as cooling medium for condensing the head fraction of the pure argon column and/or the head fraction of the crude argon column, so that, for example, a certain integration of sump heating and head cooling is attained for the pure argon column.

The invention in addition relates to an apparatus for carrying out the process according to the invention. The apparatus comprises a rectification system which includes at least one air separation column, a crude argon column, and a pure argon column, the crude argon column and an intermediate locality of the pure argon column being interconnected by a crude argon duct, wherein at least one packing is provided in the pure argon column. Preferably, a heat exchanger is connected to the upper region of the pure argon column by way of a vapor duct and by way of a condensate duct and includes a cooling medium duct and the cooling medium duct is connected to a source of cooling medium having an oxygen content of at least 10%.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

The two embodiments correspond with one another in major respects. Mutually corresponding process steps or apparatus features are denoted by the same reference numbers.

DETAILED DESCRIPTION

Figure 1:
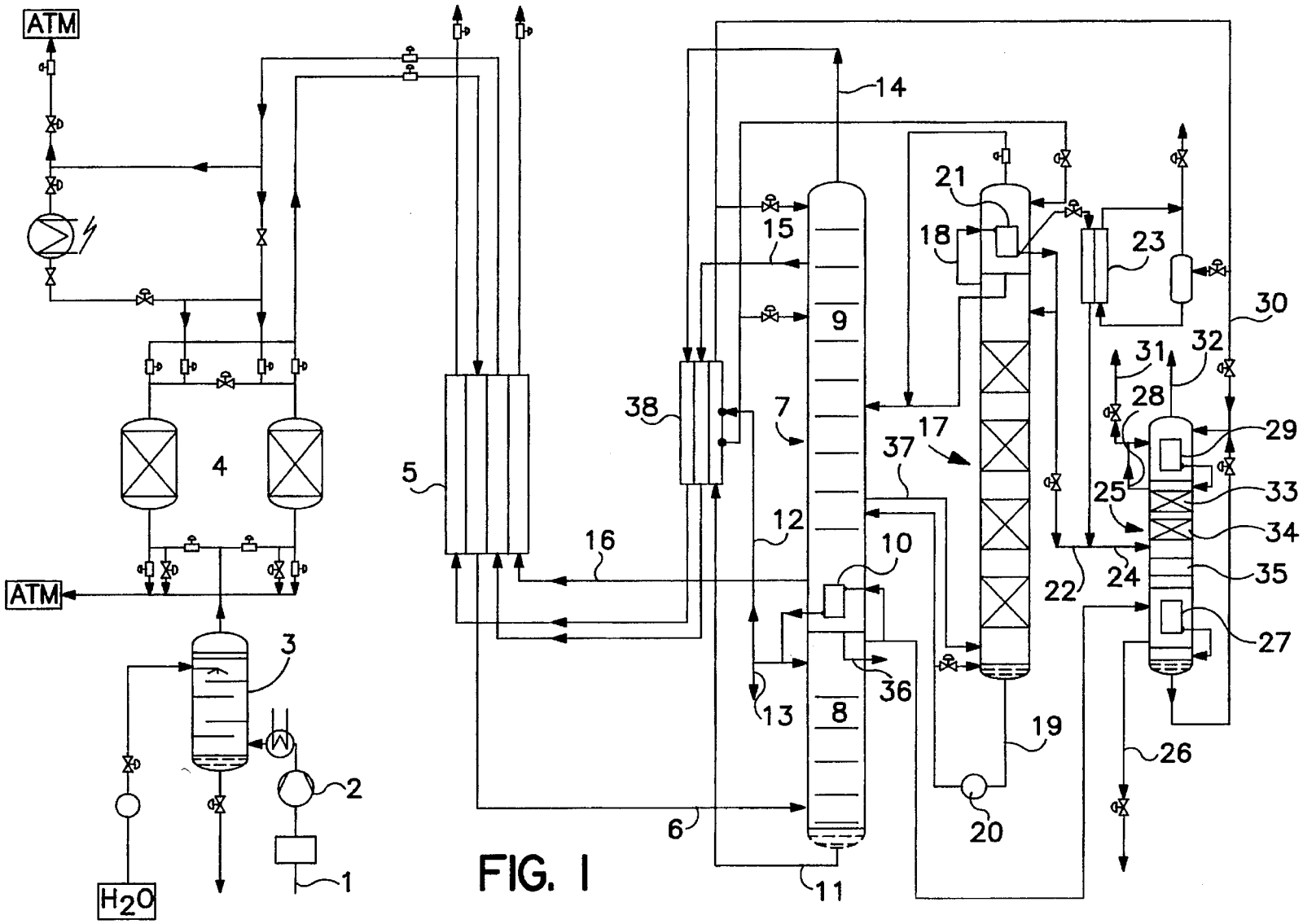
FIG. 1 illustrates an embodiment of the process and apparatus according to the invention, wherein conventional head cooling of the pure argon column is used.

Atmospheric air which is to be separated is fed in at 1, for example, through a suction filter, compressed in an air compressor 2, pre-cooled 3, e.g., by direct heat exchange with water, freed of carbon dioxide and water vapor in a molecular sieve section 4, cooled approximately to dew point in a main heat exchanger 5 and finally introduced by way of duct 6 into the high pressure stage 8 of a double column 7. The high pressure stage 8 and the low pressure stage 9 of the double column 7 are in heat exchange relationship by way of a condenser-evaporator 10. Sump liquid 11 and liquid nitrogen 12 from the high pressure column 8 are at least in part bled into the low pressure column 9. Gaseous products of the low pressure column, pure nitrogen 14, impure nitrogen 15 and gaseous oxygen 16, are heated in the main heat exchanger 5 to approximately ambient temperature against the air which is to be separated. If desired, it is also possible to recover liquid products: nitrogen by way of duct 13 and/or oxygen 36 from the sump of low pressure column 9. Particularly in the latter case, refrigeration is as a rule generated by work-producing depressurization of process flows, for example, in a refrigeration circuit operated with air or nitrogen including one, two or more flash turbines (see e.g., U.S. Pat. No. 4,883,518), or by work-producing depressurization of air to approximately the pressure level of the low pressure column 9 and direct feeding of the air (see, e.g., U.S. Pat. No. 5,019,145).

At an intermediate location, i.e., between the head and the sump, of low pressure column 9, an argon-containing oxygen fraction 37 is withdrawn and separated in a crude argon column 17 into crude argon 18 collected at the head of column 17 and a residual liquid 19 collected at the bottom which—optionally with the assistance of a pump 20—is returned to low pressure column 9. The crude argon fraction 18 is condensed at least partly in a crude argon condenser 21 by heat exchange against evaporating sump liquid from high pressure column 8. The resultant condensate is fed in part as reflux into the crude argon column 17, and another part thereof is withdrawn as intermediate product 22, 24. As shown in FIG. 1, non-condensed crude argon may be condensed in a heat exchanger 23 in heat exchange against a liquid fraction (in this case nitrogen), thereafter to be combined with the withdrawn liquid portion 22 to form a crude argon fraction 24. The crude argon fraction 24, which forms the input for the pure argon column 25, in both FIGS. 1 and 2, still contains about 0.1–1000 ppm, preferably less than 10 ppm of less volatile components (in particular oxygen) and about 0.1–5%, preferably 0.1–1%, more highly volatile impurities (in particular nitrogen).

From the sump of pure argon column 25, pure argon product 26 is withdrawn, preferably in a liquid state. The pure argon product 26 still contains by way of impurities about 0.1–1000 ppm, preferably less than about 1 ppm, oxygen and about 0.5–100 ppm, preferably about 1 ppm or less, of nitrogen.

According to the invention, the pure argon column contains a packing, preferably a structured packing. In the illustrated examples of FIGS. 1 and 2, two packing sections 33, 34 are shown above the crude argon inlet 24. It is also possible, for example, to provide only a single packing section which thereabove and/or therebelow is supplemented conventional rectifying trays. The mass transfer elements in the pure argon column above the feed locality for the crude argon fraction 24 correspond to about 2–15, preferably about 8–10 theoretical plates.

Below the crude argon inlet, about 30–50, preferably about 40–45 theoretical plates are provided. In the example of the drawing, these are represented exclusively by trays 35. However, it is also possible within the scope of the invention to employ in part, or substantially exclusively or exclusively packings, in particular structured packings.

The remaining columns of the rectifying system may contain trays and/or packings and/or combinations of both types of mass transfer elements. As illustrated in the drawings, the employment, in particular in the crude argon column of a—preferably structured—packing is advantageous because it permits the removal of oxygen purely by rectification (c.f., EP-B-0 377 117). However, the double column as well, in particular the low pressure column 9, may contain packings, preferably of the structured type.

In FIG. 1, the invention is illustrated in conjunction with conventional cooling and heating of the pure argon column 25. The sump heating 27 is operated with gaseous nitrogen derived from the head of the high pressure column 8. Overhead gas 28 of the pure argon column 25, which is composed of about 20–80%, preferably about 40–60%, nitrogen, is cooled in a head condenser 29 with nitrogen (condensate from the sump heating 27 and/or liquid 30 derived from the high pressure column 8) and partially condensed; the remaining uncondensed portion is discharged as residual gas 31. The latter may, for example, be vented into the atmosphere or, for example, jointly with the vapor 32 collected at the head condenser 29, can be fed into the impure nitrogen stream 15 from the low pressure column 9.

Figure 2:
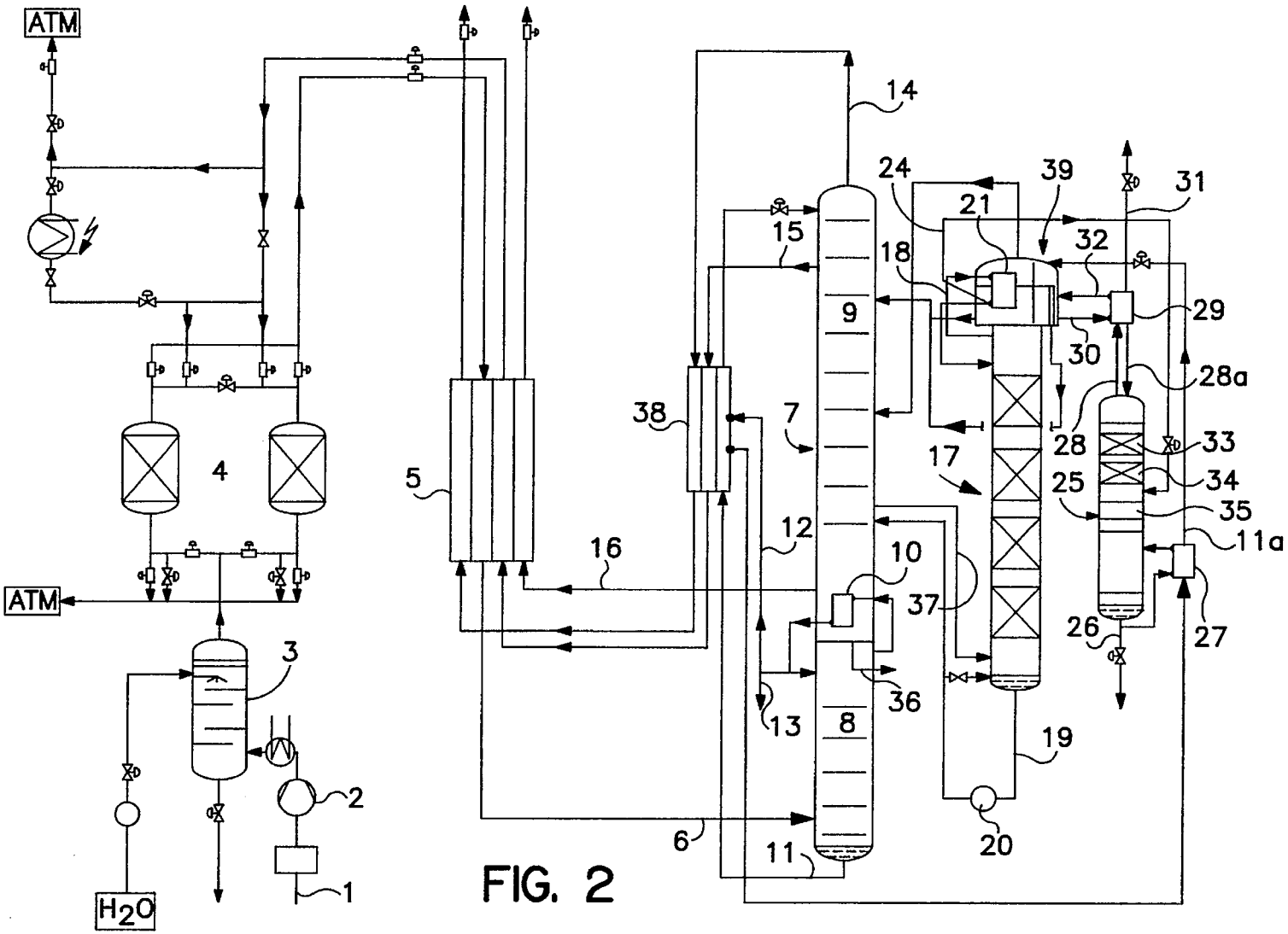
FIG. 2 illustrates a particularly preferred embodiment wherein novel head cooling of the pure argon column is used.

FIG. 2 shows an improved form of the heat withdrawal and addition for the pure argon column 25 by means of which advantages of the invention can be realized particularly effectively.

In heat exchanger 27 which serves to introduce heat into the lower region of pure argon column 25, a portion of the sump liquid from the pure argon column is evaporated in heat exchange against liquid sump fraction 11 from high pressure column 8, this fraction being maintained at a pressure of, for example, about 1–3 bar, preferably 1.2–2.0 bar. The heating medium 11 is subcooled in the course thereof.

The resultant subcooled heating medium **11*a* is used henceforth as a cooling medium for the generation of reflux for the crude argon column and the pure argon column. The head cooling of the crude argon column proceeds in a condenser-evaporator 39, into which substantially the entire sump liquid from the high pressure column 8 (after having flown through the pure argon column sump evaporator 27) is introduced, for example, more than about 70%, especially more than 90%, in particular more than 99%. (Lesser portions of the sump fraction from the high pressure column 8 may be withdrawn in a different manner, for example, by way of a safety vent). The high pressure column liquid is fed by way of a duct 11, which passes through a counter-current subcooling apparatus 38 and heat exchanger 27, into the evaporating space of the condenser-evaporator 39. Gaseous crude argon derived from the head of the crude argon column 17 is passed by way of duct 18 through a heat exchanger 21 installed in the liquid bath of condenser-evaporator 39. A portion of the condensate formed in the heat exchanger 21 is fed as reflux into the crude argon column, whereas another portion is discharged as an intermediate product 24**.

Liquid flows by way of a duct 30 to a further heat exchanger 29 which serves as head condenser for the pure argon column 25. The cooling medium evaporated in the heat exchanger 29 may be recycled by way of the duct 32 to the evaporator space of the condenser-evaporator 39. The head fraction of pure argon column 25 enters by way of duct 28 into indirect heat exchange with the cooling medium. Condensate formed thereby flows by way of conduit **28*a* back into the pure argon column 25. The gaseous remaining residue is withdrawn at 31. As regards the description of the precise mode of functioning of the head cooling of the crude and the pure argon columns as well as for further modifications of this process detail, reference is made to the German patent application P 44 06 049.1, the corresponding European patent application [EP application claiming priority from German patent applications P 44 06 049.1 and P 44 06 069.6], and corresponding U.S. patent application Ser. No. 08/307,389 (all of which have the same priority date as the present application). In the alternative to the aforegoing, it is possible to operate the head condensers 21 and 29 of the crude and the pure argon columns independently from one another in that the duct 11*a* is connected directly to the evaporator side of the overhead condenser 29 rather than or in addition to the connection between duct 11*a* and condenser-evaporator 39**.

As a departure from the drawn illustrations of the two figures, it is also possible to withdraw the head product from the crude argon column 17 in gaseous form and feed it in gaseous form into the pure argon column 25, in that, for example, the ducts 18 and 24 are interconnected upstream of the heat exchanger 21.

As an alternative to the types of sump heating for pure argon column 25 illustrated in the drawings, it is possible by way of the invention to even use gaseous air for bringing the pure argon column to boiling, for example, as shown in German patent application P 44 06 049.1, corresponding European patent application [EP application claiming priority from German patent applications P 44 06 049.1 and P 44 06 069.6]and corresponding U.S. patent application Ser. No. 08/307,389.

In the foregoing, all temperatures are set forth uncorrected in degrees Kelvin and unless otherwise indicated, all parts and percentages are by volume.

The entire disclosure of all applications, patents and publications, cited above, and of corresponding German applications P 44 06 051.2 and P 44 36 160.2, are hereby incorporated by reference.

The preceding can be repeated with similar success by substituting the generically or specifically described reactants and/or operating conditions of this invention for those used therein.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for recovering argon comprising:

separating air in at least one air separation column to provide a product oxygen stream and a product nitrogen stream, withdrawing an argon-containing oxygen stream from said air separation column and introducing said argon-containing oxygen stream into a crude argon column, withdrawing a crude argon fraction from said crude argon column and introducing said crude argon fraction at an intermediate point into a pure argon column, cooling the head of said pure argon column by indirect heat exchange, and withdrawing from an upper region of said pure argon column a residual nitrogen-containing fraction and withdrawing from a lower region of said pure argon column a pure argon fraction, wherein mass transfer in said pure argon column is brought about, at least in part, by a packing contained therein.

2. A process according to claim 1, wherein mass transfer in said pure argon column, above the intermediate point at which said crude argon fraction is introduced, is performed at least in part by packing contained in said pure argon column.

3. A process according to claim 2, wherein mass transfer in said pure argon column, below the intermediate point at which said crude argon fraction is introduced, is performed at least in part by trays.

4. A process according to claim 3, wherein mass transfer in said pure argon column, below the intermediate point at which said crude argon fraction is introduced, is performed substantially exclusively by trays.

5. A process according to claim 2, wherein mass transfer in said pure argon column, below the intermediate point at which said crude argon fraction is introduced, is performed at least in part by packing.

6. A process according to claim 2, wherein mass transfer in said pure argon column, above the intermediate point at which said crude argon fraction is introduced, is performed substantially exclusively by packing.

7. A process according to claim 6, wherein mass transfer in said pure argon column, below the intermediate point at which said crude argon fraction is introduced, is performed at least in part by trays.

8. A process according to claim 7, wherein mass transfer in said pure argon column, below the intermediate point at which said crude argon fraction is introduced, is performed substantially exclusively by trays.

9. A process according to claim 6, wherein mass transfer in said pure argon column, below the intermediate point at which said crude argon fraction is introduced, is performed at least in part by packing.

10. A process according to claim 1, wherein mass transfer in said pure argon column, below the intermediate point at which said crude argon fraction is introduced, is performed at least in part by trays.

11. A process according to claim 10, wherein mass transfer in said pure argon column, below the intermediate point at which said crude argon fraction is introduced, is performed substantially exclusively by trays.

12. A process according to claim 1, wherein mass transfer in said pure argon column, below the intermediate point at which said crude argon fraction is introduced, is performed at least in part by packing.

13. A process according to claim 1, wherein mass transfer in the entirety of said pure argon column is substantially exclusively brought about by packing.

14. A process according to claim 1, wherein said indirect heat exchange for cooling the head of said pure argon column is carried out by means of a cooling medium having an oxygen content of at least 10%.

15. A process according to claim 14, wherein said cooling medium is withdrawn from an intermediate region of said at least one air separation column.

16. A process according to claim 14, wherein said cooling medium is withdrawn from a lower region of said at least one air separation column.

17. A process according to claim 16, wherein said at least one air separation column is a double column comprising a high pressure column and a low pressure column, and said cooling medium is withdrawn from a lower region of said high pressure column.

18. A process according to claim 17, wherein sump liquid collected in the lower region of said high pressure column is employed as said cooling medium.

19. A process according to claim 16, wherein said at least one air separation column is a double column comprising a high pressure column and a low pressure column, and said cooling medium is withdrawn from an intermediate region of said high pressure column.

20. An apparatus comprising:

at least one air separation column having an inlet for introduction of air, a first outlet for removal of an oxygen-containing stream and a second outlet for removal of a nitrogen-containing stream, conduit means in fluid communication with said air separation column and with a crude argon column, a pure argon column having a first outlet in a lower region thereof for removal of an argon stream and a second outlet in an upper region thereof for removal of a nitrogen-containing stream, said crude argon column and an intermediate point of said pure argon column being connected by a crude argon duct, and wherein said pure argon column contains at least one packing.

21. An apparatus according to claim 20, further comprising a heat exchanger connected to the upper region of said pure argon column by way of a vapor duct and by way of a condensate duct, and a cooling medium duct which is connected to said heat exchanger and to a source of cooling medium having an oxygen content of at least 10%.

* * * * *